US008251782B2

(12) United States Patent
Riedl et al.

(10) Patent No.: US 8,251,782 B2
(45) Date of Patent: Aug. 28, 2012

(54) ACCUMULATOR DRIVEN ANGLE GRINDER

(75) Inventors: Reinhard Riedl, Finning (DE); Christian Koschel, Augsburg (DE)

(73) Assignee: Hilti Aktiengesellschaft, Schaan (LI)

( * ) Notice: Subject to any disclaimer, the term of this patent is extended or adjusted under 35 U.S.C. 154(b) by 337 days.

(21) Appl. No.: 12/587,055

(22) Filed: Sep. 30, 2009

(65) Prior Publication Data

US 2010/0087127 A1 Apr. 8, 2010

(30) Foreign Application Priority Data

Oct. 3, 2008 (DE) ..... 10 2008 042 601

(51) Int. Cl.
*B24B 23/02* (2006.01)
*B24B 41/02* (2006.01)

(52) U.S. Cl. ..... 451/359; 451/451

(58) Field of Classification Search ..... 451/359, 451/358, 344, 353, 354, 456
See application file for complete search history.

(56) References Cited

U.S. PATENT DOCUMENTS 4,158,246 A * 6/1979 Meadows et al. ..... 15/28
4,967,516 A * 11/1990 Hoshino et al. ..... 451/359
6,514,131 B1 * 2/2003 Reich et al. ..... 451/344
6,699,111 B2 * 3/2004 Legner et al. ..... 451/344
6,910,960 B2 * 6/2005 Reich et al. ..... 451/451
7,310,879 B1 12/2007 Clarke
2003/0115995 A1 6/2003 Hofmann
2004/0045176 A1 3/2004 Koukal
2007/0240892 A1 10/2007 Brotto

FOREIGN PATENT DOCUMENTS

DE 35 02 449 C3 8/1985
DE 201 11 644 U1 10/2001
DE 203 18 670 U1 4/2004

* cited by examiner

*Primary Examiner* — Dung Van Nguyen
(74) *Attorney, Agent, or Firm* — Abelman, Frayne & Schwab

(57) ABSTRACT

An angle grinder for driving a cutting or grinding tool (12), includes a housing (11) having a first housing section (14) extending along a first axis (A1), and in which a motor (18) is arranged, and a second housing section (15) extending along a second axis (A2) and in which an accumulator receptacle is arranged, with the first and second axes (A1, A2) extending at an angle (α) to each other; and with a handle (20) having its first end (21) secured to the first housing section (14) and its second end (22) secured to the second housing section (15).

2 Claims, 2 Drawing Sheets

ACCUMULATOR DRIVEN ANGLE GRINDER

BACKGROUND OF THE INVENTION

1. Field of the Invention

The present invention relates to an accumulator-driven angle grinder for driving cutting or grinding disc-shaped tools.

2. Description of the Prior Art

Angle grinders of the type described above have a circular, disc-shaped cutting or grinding tool rotatable during the operation of the angle grinder, e.g., to form cuts in workpieces or for grinding surfaces. The cutting or grinding tool is circumferentially covered, at least regionwise, by a protection hood.

German Publication DE 100 39 777 A1 discloses a battery-powered electrical tool formed as an angle grinder and having an elongate housing. The grinder housing has an elongate bar-shaped housing part with an electrical drive motor, and an end part an end-side connection surface of which is provided with a plug receptacle for a releasable attachment of an accumulator package provided with a connection element having a bearing surface corresponding to the connection surface of the end part for bearing against the connection surface. The bearing surface is provided with a plug element engageable in a plug receptacle provided in the connection surface. The end part extends at an angle to the longitudinal extent of the housing part.

The drawback of the above-described known angle grinder consists in that the housing section that surrounds the motor serves as a handle which has a relatively large diameter and which is, therefore, unwieldy to be grasped. Further, the weight distribution is not favorable for a user hand grasping the housing because of different separate gravity points (e.g., of accumulator package, motor, working tool). This results in a too large torque acting on the user wrist.

Accordingly, an object of the present invention is to provide an angle grinder in which the above-mentioned drawbacks of the known angle grinder are eliminated.

Another object of the invention is to provide a constructively simple angle grinder.

SUMMARY OF THE INVENTION

These and other objects of the present invention, which will become apparent hereinafter, are achieved by providing an angle grinder including a housing having a first housing section extending along a first axis and a second housing section extending along a second axis, with the first and second axes extending at an angle to each other, a handle having its first end secured to the first housing section and its second end secured to the second housing section, a motor for driving the cutting or grinding tool and arranged in the first housing section and an accumulator receptacle provided in the second housing section.

With the handle being attached at its opposite ends to two housing sections, there is provided an angle grinder which is easy to handle and which is shorter due to the angular arrangement of the housing sections.

Advantageously, the angle between the first and second axes lies in a range between 10° and 65°. This insures that both housing sections can be connected by the handle, without the user experiencing an uncomfortable touching of the contour of the second housing section.

The inventive angle grinder has a gravity center which results from different gravity centers of components of the angle grinder and which lies on the first axis, with the handle having a gripping region spaced from the first axis and a gravity center of which is spaced from the gravity center of the angle grinder along a perpendicular to the first axis. This arrangement of the handle results in a balanced power tool during operation of which hardly any torque acts on the wrist of a hand holding the tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

In the drawings, the same components are designated with the same reference numerals.

DETAILED DESCRIPTION OF THE PREFERRED EMBODIMENTS

Figure 1:
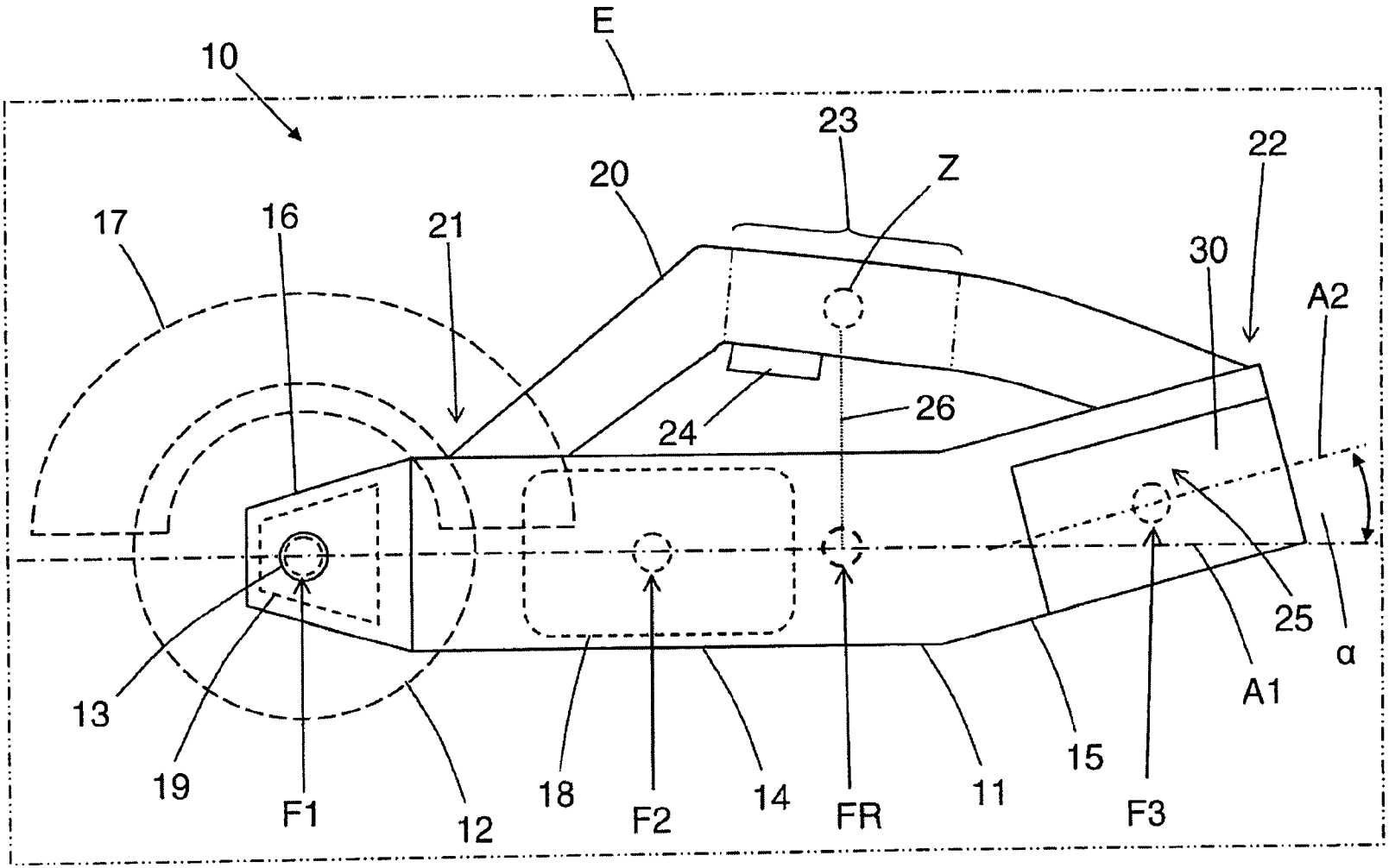
FIG. 1 a side view of a first embodiment of an angle grinder according to the present invention.

A network-independently driven angle grinder 10, a first embodiment of which is shown in FIG. 1, includes a housing 11 and a drive unit located in the housing for driving a disc-shaped cutting or grinding tool 12 (shown only schematically in FIG. 1). The cutting or grinding tool 12 is securable on a drive spindle 13 projecting from the housing 11 through a flange 16. On the housing 11, a protection hood 17 (shown only schematically) for the cutting and grinding tool can be arranged. The protection hood 17 can at least partially cover the cutting and grinding tool 12. In addition to the flange 16 in which the gearset 19 is received, the housing 11 has a first housing section 14 which extends along a first axis A1 and which accommodates a motor 18 of the drive unit for driving the cutting and grinding tool 12, and a second housing section 15 which extends along a second axis A2 and which accommodates an accumulator receptacle 25. In FIG. 1, an electrical energy storing means in form of accumulator 30 is releasably received in the receptacle 25. The accumulator 30 extends, with its longitudinal extent, along the second axis A2. The second housing section 15 extends at an angle to the first housing section 14, with the axes A1 and A2 forming an angle ($\alpha$) with each other. In the angle grinder 10 shown in FIG. 1 this angle ($\alpha$) amounts to 15°.

The angle grinder 10 further has a handle 20 having its first end 21 secured to the first housing section 14 and its second end 22 secured to the second housing section 15. The handle 20 extends in a plane E defined by axes A1 and A2. the handle 20 is formed as a bridge-shaped element and extends in a region stretching in a space between the first housing section 14 and the second housing section 15.

The handle 20 has a gripping region 23 in which there is provided a switch 24 for turning the angle grinder on and off. The gripping region 23 of the handle 20 is spaced from the housing 11. The gravity center Z of the gripping region 23 is located substantially perpendicular to the first axis A and is spaced from the gravity center FR of the angle grinder 10 along the perpendicular to the axis A1 (shown with a dot line 26 in FIG. 1). The gravity center FR results from different gravity centers of the angle grinder components (F1, F2, F3 . . . ) and, in particular, first gravity center F1 formed in the region of the drive spindle 13, with the gear set 19 and the cutting and grinding tool 12, second gravity center F2 in the region of the motor 18, and third gravity center F3 in the region of the accumulator 30 received in the accumulator receptacle 25.

Figure 2:
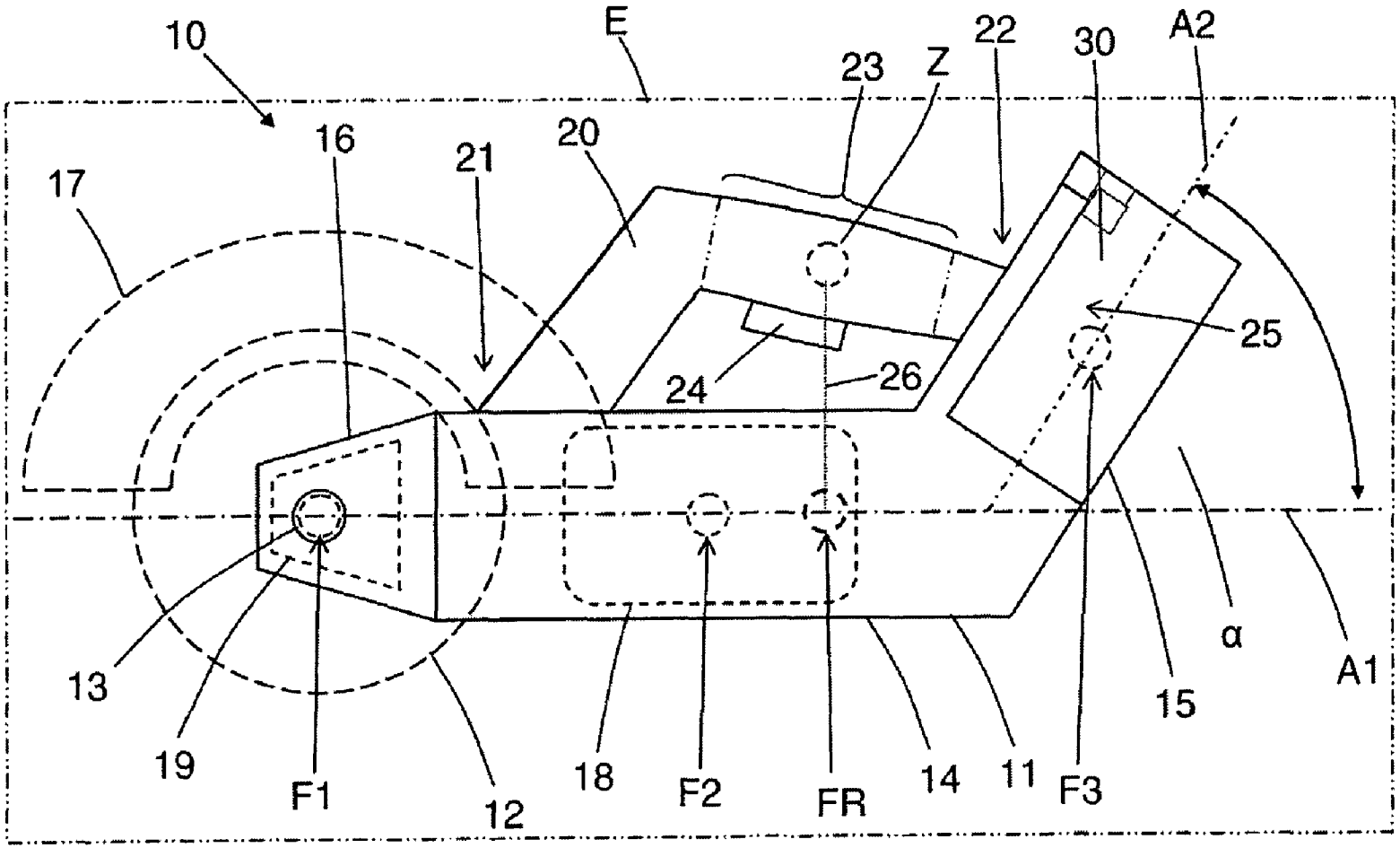
FIG. 2 a side view of a second embodiment of an angle grinder according to the present invention.

FIG. 2 shows a second embodiment of the angle grinder 10 according to the present invention which differs from the above-described first embodiment in that the second housing section 15 with the accumulator receptacle 25 and the accumulator 30 is deflected from the first housing section 14 at a greater angle.

In the embodiment of FIG. 2, the axis A2 of the second housing section 15 extends at an angle of 60° to the first axis A1 of the first housing section 14. For description of other components and their function reference should be made in its entirety to the description of the invention made with reference to FIG. 1.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. An angle grinder for driving a cutting or grinding tool (12), comprising a housing (11) having a first housing section (14) extending along a first axis (A1); and a second housing section (15) extending along a second axis (A2), the first and second axes (A1, A2) extending at an angle ($\alpha$) to each other; a handle (20) having a first end (21) thereof secured to the first housing section (14) and a second end thereof (22) secured to the second housing section (15); a motor (18) for driving the cutting or grinding tool (12) and arranged in the first housing section (14); and an accumulator receptacle (25) provided in the second housing section (15), wherein a gravity center (FR) of the angle grinder, which results from different gravity centers (F1, F2, F3) of components of the angle grinder, lies on the first axis (A1), and wherein the handle (20) has a gripping region (23) spaced from the first axis (A1) and a gravity center (Z) of which is spaced from the gravity center (FR) of the angle grinder along a perpendicular to the first axis (A1).

2. An angle grinder according to claim 1, wherein the angle ($\alpha$) between the first and second axes (A1, A2) lies in a range between 10° and 65°.

* * * * *